United States Patent [19]

Spademan

[11] 4,395,055

[45] Jul. 26, 1983

[54] SKI RELEASE SIDE CLAMPING BINDING WITH HINGED JAW MEMBERS

[76] Inventor: Richard G. Spademan, 1421 Old County Rd., Belmont, Calif. 94002

[21] Appl. No.: 890,574

[22] Filed: Mar. 20, 1978

[51] Int. Cl.[3] ..... A63C 9/08

[52] U.S. Cl. ..... 280/624

[58] Field of Search ..... 280/624, 625, 626, 623

[56] References Cited

U.S. PATENT DOCUMENTS

| | | | |
|---|---|---|---|
| Re. 26,972 | 10/1970 | Spademan | 280/624 |
| 3,606,370 | 9/1971 | Spademan | 280/624 |
| 3,806,143 | 4/1974 | Wyss | 280/625 |
| 4,017,098 | 4/1977 | Kirsch | 280/625 |

*Primary Examiner*—Robert R. Song

*Attorney, Agent, or Firm*—Townsend and Townsend

[57] ABSTRACT

A ski release side clamping binding with hinged jaw members is described. In the binding there is provided a housing. In the interior of the housing there is movably mounted a pair of housing mounted plate members. To each of the housing mounted plate members there is pivotably attached a jaw member. Coupled to the jaw member is a resilient clamping member. The resilient clamping means is provided for resiliently releasably clamping a ski boot between the jaw members. In use, the jaw members are free to pivot downwardly when the jaw members have moved outwardly a specified distance from the housing against the restraining force of the resilient clamping member. The downward pivoting of the jaw members is provided for removing a potential obstruction to the movement of the ski boot by the jaw members during a rotational release and the like.

7 Claims, 6 Drawing Figures

SKI RELEASE SIDE CLAMPING BINDING WITH HINGED JAW MEMBERS

BACKGROUND OF THE INVENTION

The present invention relates to ski release bindings in general and in particular to ski release side clamping bindings of the type disclosed and described in applicant's U.S. Pat. Nos. Re. 26,972 and 3,606,370.

Referring to U.S. Pat. No. Re. 26,972 and in particular to the embodiments disclosed and described with respect to FIGS. 7–10 and 17–21, there is provided respectively a pair of jaw members 240 and 540. In U.S. Pat. No. 3,606,370 there is provided a pair of jaw members 6. In each of the embodiments the jaw members are coupled to a means for resiliently releasably clamping a ski boot between the jaw members. In U.S. Pat. No. Re. 26,972 the clamping means is designated generally as 16 and in U.S. Pat. No. 3,606,370 the clamping means is designated generally as 7.

In the patents and in particular the embodiments referred to above, the jaw members in a releasing condition and in particular, during a rotational release, are caused to move outwardly relative to a housing in which they are movably mounted. In no case, however, does either of the jaw members in any pair move entirely out of the plane of movement of a ski boot clamped therebetween. During a release involving longitudinal movement of a ski boot relative to a ski or heel lifting movement of a ski boot relative to a ski, the presence of the jaw members along the sides of the ski boot presents no problem by way of an obstruction or impediment to the movement. During a rotational release, however, the presence of the jaw members is found to present a potential obstruction of the jaw members with the side of the ski boot.

SUMMARY OF THE INVENTION

In view of the foregoing, a principal object of the present invention is a ski release binding in general and in particular a ski release side clamping binding with means for moving the jaw members away from the plane of movement of a ski boot after the ski boot has moved the jaw members laterally a predetermined distance against the restraining force of a resilient clamping means.

Another object of the present invention is a ski release binding comprising a pair of side clamping jaw members and means for pivoting the jaw members below the plane of movement of a ski boot during a rotational release.

In accordance with the above objects there is provided in a preferred embodiment of the present invention, a pair of plate members movably mounted in a housing. Pivotably attached to each of the housing mounted plate members, as by a hinging means, there is provided a jaw member. The hinging means comprises a plurality of spaced U-shaped pin-receiving interleaved hinging members on the facing ends of the housing mounted plate members and jaw members and hinge pin members for interlocking the U-shaped hinging members.

The housing in which the housing mounted plate members are movably mounted comprises an upper plate member and a lower plate member. The lower plate member is provided with lateral edges which are formed for restricting during a release the maximum angle through which the jaw members are free to pivot relative to the housing mounted plate members to which they are pivotably attached. Also, the lateral edges of the lower housing plate member are located interior of the corresponding lateral edges of the upper housing plate member for preventing an involuntary separation of the jaw member from the housing mounted plate members to which they are attached when the jaw members have pivoted to their maximum angular position relative to the plate members. The open construction of the U-shaped hinging members which requires the precaution against involuntary separation facilitates manufacture and assembly by being simple and relatively inexpensive to fabricate.

BRIEF DESCRIPTION OF THE DRAWINGS

The above and other objects, features and advantages of the present invention will become apparent from the following detailed description of the accompanying drawings in which.

DETAILED DESCRIPTION

Figure 1:
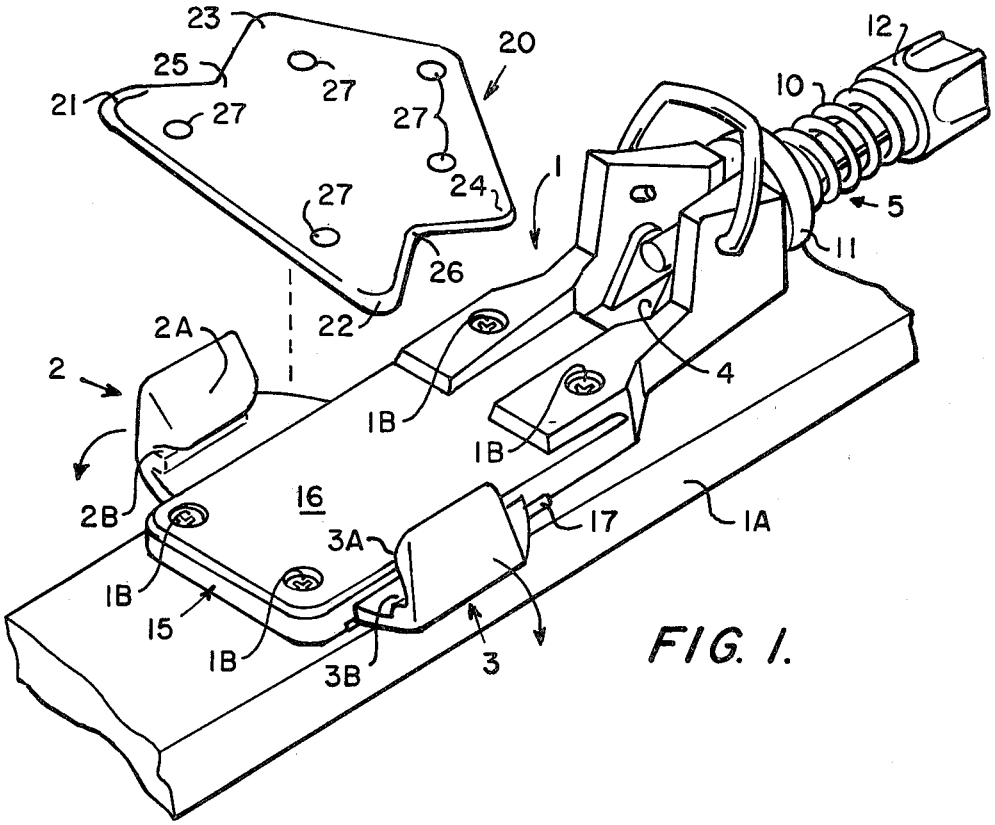
FIG. 1 is an isometric view of the boot and ski-mounted parts of a ski release binding according to the present invention.

Referring to FIG. 1, there is provided a ski release binding designated generally as 1 mounted on a ski 1A as by screws 1B. In the binding 1 there is provided a pair of side clamping jaw assemblies 2 and 3. The jaw assemblies 2 and 3 are provided with facing overhanging protuberances 2A and 3A, respectively. The protuberances 2A and 3A overhang shoulders 2B and 3B, respectively. Internally the jaw assemblies 2 and 3 are connected by means of a connecting strip 4 to a resilient releasable clamping assembly 5.

In the clamping assembly 5 there is provided a spring member 10, a washer 11 and adjusting knob 12. The clamping assembly 5 is substantially identical to the clamping assembly described in the above identified U.S. Pat. No. 3,606,370 and it is believed, for that reason, need not be further described herein for a full understanding thereof.

The side clamping jaw assemblies 2 and 3 are movably mounted in a housing 15. In the housing 15 there is provided an upper plate member 16 and a lower plate member 17 as will be further described below.

Shown above the housing 15 in FIG. 1 there is provided a plate member 20. Along its lateral edges the plate member 20 is provided with a pair of forward tip members 21 and 22 and a pair of rearward tip members 23 and 24. Between the tip members 21 and 23 there is provided an area of reduced cross section forming a triangularly-shaped recess 25. Similarly between the tip members 22 and 24 there is provided an area of reduced cross section forming a similar triangularly-shaped recess 26. The lateral edges of the plate 20 between the tip members 21 and 23 and the tip members 22 and 24 are beveled for fitting snugly beneath the facing protuberances 2A and 3A on the shoulders 2B and 3B of the jaw assemblies 2 and 3 respectively. At suitable locations in the plate member 20 there is provided a plurality of holes 27 for mounting the plate member 20 to the sole of a ski boot as by screws or the like. Alternatively, separate means such as L-shaped brackets may be mounted on the sides of a ski boot or receiver means molded in the sides of a ski boot instead of the plate 20 for engaging the facing protuberances 2A and 3A of the jaw assemblies 2 and 3 if preferred.

Figure 3:
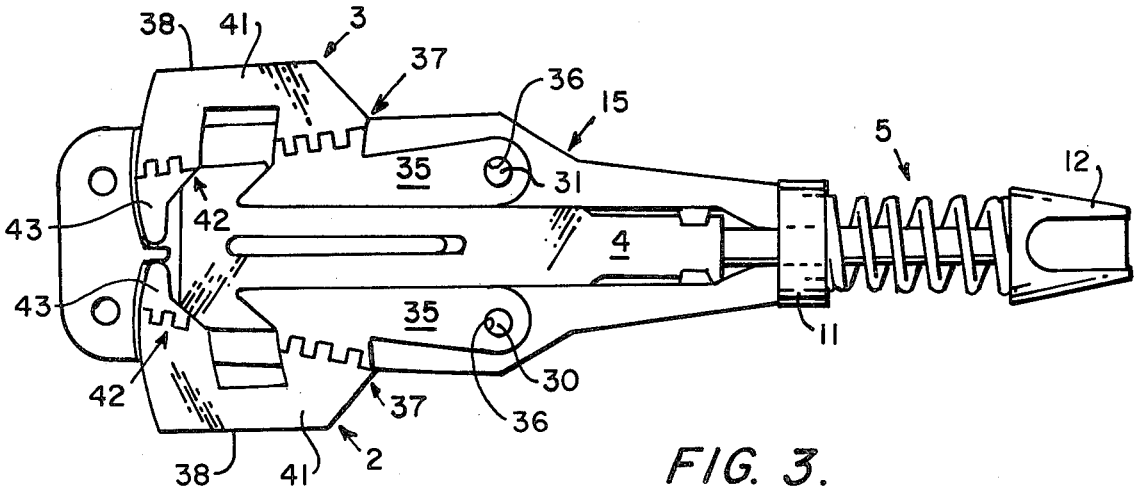
FIG. 3 is a bottom plan view of the apparatus of FIG. 1.

Referring to FIG. 3, the jaw assemblies 2 and 3 are pivotably mounted in the housing 15 for pivoting about a pair of pivot posts 30 and 31, respectively. Both of the jaw assemblies 2 and 3 are substantially identical except for the fact that one is the mirror image of the other in that one clamps the right side of the boot while the other clamps the left side of the boot. Because of their similarity only one of the jaw assemblies, jaw assembly 3, need be described in detail.

Referring to FIG. 3, there is provided in the jaw assembly 3 a pivotable plate member 35. In the plate member 35 there is provided at one end a pivot hole 36. The pivot hole 36 is provided for receiving the pivot post 31. At the opposite end of the pivotable plate member 35 there is provided a hinge 37. The hinge 37 is provided for pivotably coupling the pivotable plate member 35 to a jaw member 38. As seen clearly in FIGS. 3 and 5, jaw member 38 comprises the curved protuberance 3A and the shoulder 3B which extend substantially perpendicular to a U-shaped base 41. Attached to the opposite leg of the U-shaped base 41 as by a hinge 42, there is provided a relatively short plate member 43.

Figure 5:
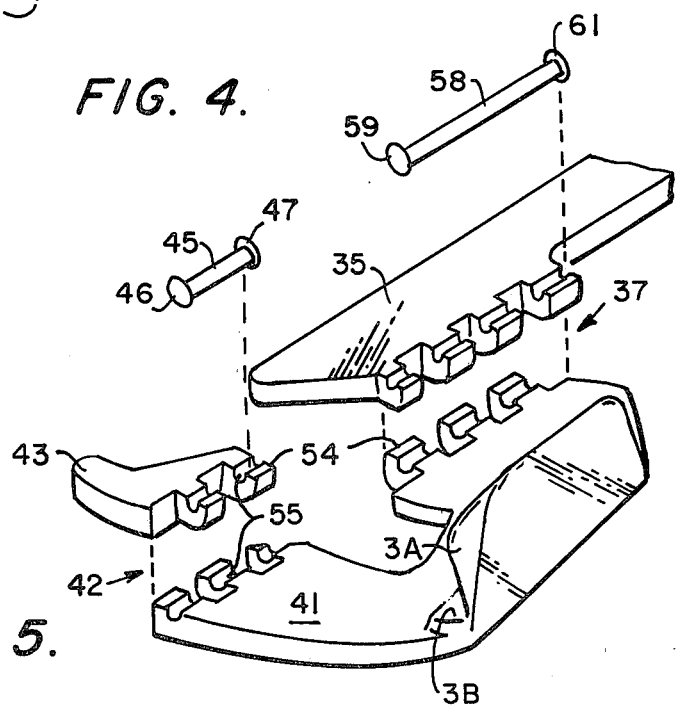
FIG. 5 is an exploded isometric view of a hinged jaw member according to the present invention.

Referring to FIG. 5, in the facing edges of the plate members 35, 41 and 43, there is provided a plurality of U-shaped hinging members 54. Each of the U-shaped hinging members 54 is provided with a U-shaped cavity or recess 55. For interlocking the plate members 35 and 41, there is provided a hinge pin 58. For interlocking the plate members 43 and 41, there is provided a hinge pin 45. At each end of the hinge pins 58 and 45 there is provided a flange butt or member 59 and 61, and 46 and 47, respectively. The members 59 and 61, 46 and 47 are provided for preventing the hinge pins 58 and 45 from slipping laterally from the U-shaped recesses 55.

To assemble the plate members 35, 41 and 43, the plate members 35, 41 and 43 are interleaved and the hinge pins 58 and 45 inserted in the recesses 5.

Figure 2A:
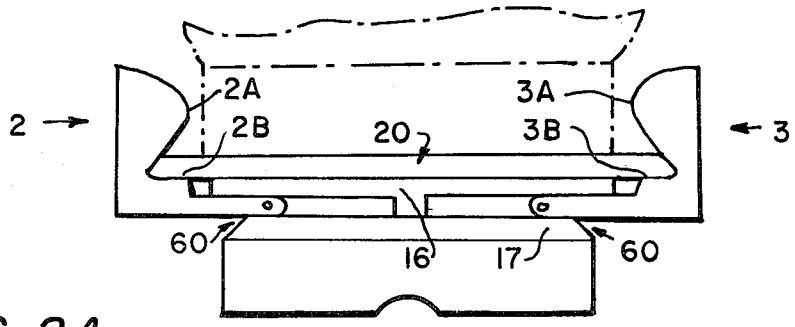
FIG. 2A is a transverse cross-sectional view of the jaw members and boot plate of FIG. 1.
Figure 2B:
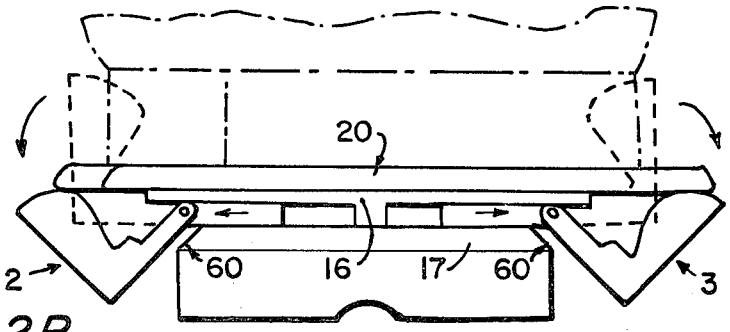
FIG. 2B is a view of FIG. 2A with the jaw members in a downwardly pivoted releasing position.
Figure 4:
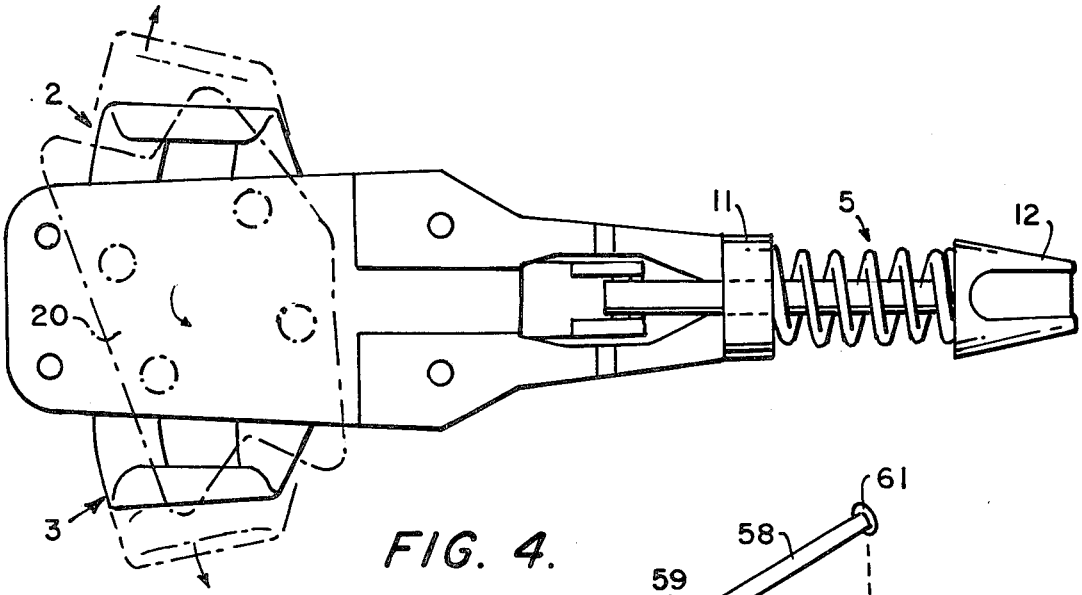
FIG. 4 is a top plan view of FIG. 1 showing a rotational releasing of the boot plate.

Referring to FIGS. 2A, 2B and 4, during a rotational release when the ski boot is undergoing a twisting or rotational motion relative to a ski, the plate 20 mounted to the sole of the boot moves the jaw assemblies 2 and 3 laterally apart against the restraining force of the clamping assembly 5. After the jaw assemblies 2 and 3 have moved a predetermined distance laterally, the jaw members are free to pivot away from the plane of movement of the plate 20 and the ski boot to which they are mounted.

As seen in FIGS. 2A and 2B and as previously described, the housing 15 comprises an upper housing plate member 16 and a lower housing plate member 17. The lower housing plate member 17 is spaced from the upper housing plate member 16 and has a lateral edge which is formed as by a bevel 60 for restricting during release the maximum angle through which a jaw member is free to pivot relative to the housing mounted plate member to which it is pivotably attached. As should be noted, the bevel 60 is located interior of the corresponding lateral edge of the upper housing plate member 16. The purpose of this arrangement, in addition to restricting the angle through which the jaw member is free to pivot, also prevents dislocation of the hinge pins 58 and 45 from the U-shaped recesses 55 and involuntary separation of the jaw members from the housing mounted plate members to which they are attached.

While an embodiment of the present invention is described, it is contemplated that still other changes and modifications may be made by those skilled in the art without departing from the spirit and scope thereof. For example, instead of U-shaped hinging members as described, conventional door-type hinging members may be used. Accordingly it is intended that the scope of the present invention not be limited to the embodiments described herein but rather be determined by reference to the claims hereinafter provided and their equivalents.

What is claimed is:

1. In a ski release binding comprising at least one movable jaw member and means for releasably clamping a ski boot to a ski with the jaw member rearward of the toe and forward of the rear of the heel of the ski boot wherein, during release, the jaw member is moved, the improvement comprising means for allowing the jaw member to move in a second direction after the jaw member is moved a predetermined distance in a first direction.

2. In a ski release binding comprising at least one movable jaw member and means for releasably clamping a ski boot to a ski with the jaw member rearward of the toe and forward of the rear of the heel of the ski boot wherein, during release, the jaw member is moved, the improvement comprising:

a housing;

means allowing the jaw member to move in a second direction after the jaw member is moved a predetermined distance in a first direction;

a member movably mounted in the housing for coupling a clamping force to the jaw member; and means for attaching the jaw member to said movably mounted member for movement in said second direction.

3. An improvement according to claim 2 wherein the attaching means comprises hinging means.

4. An improvement according to claim 2 wherein the attaching means comprises a plurality of spaced U-shaped pin receiving hinge members on the facing ends of the housing mounted plate member and jaw member for receiving a hinge pin member, and a hinge pin member for interlocking the U-shaped hinge members.

5. An improvement according to claim 4 comprising means for preventing an involuntary separation of the U-shaped pin receiving hinge members and a detachment of the jaw member from the housing mounted plate member.

6. An improvement according to claim 5 comprising an upper housing plate member and a lower housing plate member for housing the housing mounted plate member and the interior ends of the jaw member, said lower housing plate member being spaced from the upper housing plate member and having a lateral edge which is formed for restricting, during a release, the maximum angle through which the jaw member is free to pivot relative to the housing mounted plate member to which it is pivotably attached and which is located interior of the corresponding lateral edge of the upper housing plate member for preventing an involuntary separation of the jaw member from the plate member to which it is attached when the jaw member has pivoted to its maximum angular position relative to the plate member to which it is attached.

7. In a ski release binding comprising at least one movable jaw member and means for releasably clamping a ski boot to a ski with the jaw member rearward of the toe and forward of the rear of the heel of the ski boot wherein, during release, the jaw member is moved, the improvement comprising:

means allowing the jaw member to move in a second direction after the jaw member is moved a predetermined distance in a first direction; and means for allowing the jaw member to move below the plane of movement of the ski boot when said jaw member is moving in said second direction.

* * * * *